US007541543B2

(12) United States Patent
Head

(10) Patent No.: US 7,541,543 B2
(45) Date of Patent: Jun. 2, 2009

(54) CABLES

(76) Inventor: Philip Head, Turbogenset House Heathrow Summit Centre Skyport D, West Drayton (GB)

( * ) Notice: Subject to any disclaimer, the term of this patent is extended or adjusted under 35 U.S.C. 154(b) by 21 days.

(21) Appl. No.: 11/792,104

(22) PCT Filed: Dec. 1, 2005

(86) PCT No.: PCT/GB2005/050225

§ 371 (c)(1),
(2), (4) Date: May 31, 2007

(87) PCT Pub. No.: WO2006/059157

PCT Pub. Date: Jun. 8, 2006

(65) Prior Publication Data

US 2008/0142244 A1 Jun. 19, 2008

(30) Foreign Application Priority Data

Dec. 1, 2004 (GB) ..... 0426338.0

(51) Int. Cl.
*H01B 7/18* (2006.01)

(52) U.S. Cl. ..... 174/102 R

(58) Field of Classification Search ..... 174/102 R, 174/102 C, 103, 106 R, 107, 108, 110 R, 174/110 S, 113 R, 116
See application file for complete search history.

(56) References Cited

U.S. PATENT DOCUMENTS

| | | | | |
|---|---|---|---|---|
| 2,953,627 | A * | 9/1960 | Malneritch et al. | 174/102 R |
| 3,328,140 | A * | 6/1967 | Warren | 428/602 |
| 3,602,632 | A * | 8/1971 | Ollis | 174/36 |
| 3,773,109 | A * | 11/1973 | Eberline | 340/855.1 |
| 3,784,732 | A * | 1/1974 | Whitfill, Jr. | 174/108 |
| 4,440,974 | A * | 4/1984 | Naudet | 174/108 |
| 6,600,108 | B1 * | 7/2003 | Mydur et al. | 174/120 R |
| 6,631,095 | B1 * | 10/2003 | Bryant et al. | 367/20 |
| 7,119,283 | B1 * | 10/2006 | Varkey et al. | 174/102 R |
| 7,259,331 | B2 * | 8/2007 | Sridhar et al. | 174/102 R |
| 7,294,787 | B2 * | 11/2007 | Varkey | 174/102 R |
| 2007/0003780 | A1 * | 1/2007 | Varkey et al. | 428/586 |
| 2007/0044993 | A1 * | 3/2007 | Varkey | 174/102 R |
| 2007/0102186 | A1 * | 5/2007 | Varkey | 174/102 R |

* cited by examiner

*Primary Examiner*—William H Mayo, III
(74) *Attorney, Agent, or Firm*—Andrew Wilford

(57) ABSTRACT

An electrically powered tool down in a borehole is suspended from a cable that also supplies electrical power to the tool. The cable has a conducting member of sufficient tensile strength to support the majority of the weight of the tool and an insulating layer surrounding the conducting member.

10 Claims, 8 Drawing Sheets

CABLES

CROSS REFERENCE TO RELATED APPLICATIONS

This application is the US national phase of PCT application PCT/GB2005/050225, filed 1 Dec. 2005, published 8 Jun. 2006 as WO2006/059157, and claiming the priority of British patent application 04263.38.0 itself filed 1 Dec. 2004, whose entire disclosures are herewith incorporated by reference.

FIELD OF THE INVENTION

This invention relates primarily but should not be limited to oil well cables which are used to provide electrical power and be capable of being suspended for very large vertical distances and suspend heavy loads or tool assemblies at the same time.

BACKGROUND OF THE INVENTION

Cables suspended in boreholes conventionally have a central core of electrical cables encased in a torque balanced steel wire sheath which supports the load of the electrical cables and any payload that may be suspended from the cable. The steel wire sheath adds considerable weight to the cable, part of which is due to having to support itself, and also contributes the width of the cable.

OBJECT OF THE INVENTION

It is an object of the invention to provide an electrical cable for downhole use of low cost, weight and diameter.

SUMMARY OF THE INVENTION

According to the invention there is provided a cable for supplying electrical power having a conducting member that is part of the load bearing system Ideally, the cable is used to carry a payload.

BRIEF DESCRIPTION OF THE DRAWING

By way of example the following figures will be used to describe two embodiments of the invention.

SPECIFIC DESCRIPTION

Figure 1:
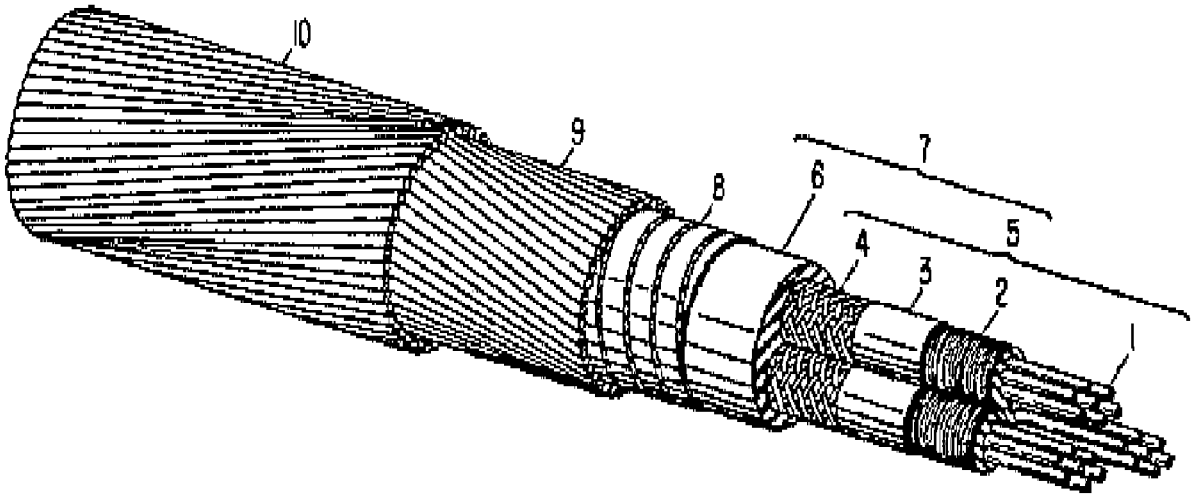
FIG. 1 is an illustration of a conventional electro-mechanical cable.

Referring to FIG. 1 reference numerals 1-4 designate components of insulated conductor means 5, and reference numerals 5 and 6 designate components of cable core 7. The insulated conductor means 5 comprises conductors 1, of stranded or solid copper, for example, surrounded integrally by conductor insulation 2 formed of an elastomer such as EPDM (ethylene propylene diene monomer) and constituting the primary electrical insulation on the conductors. Insulation 2 is surrounded by helically wound Teflon tape 3 that protects the conductor insulation from attack by well fluid. Nylon braid 4 is used to hold the tape layer on during manufacturing processing. The tape layer facilitates axial movement of the insulated conductors relative to core jacket 6 to prevent damage to the cable when the cable is bent. The core jacket 6 is formed of an elastomer such as EPDM or nitrile rubber. The tape-wrapped insulated conductors are embedded in the core jacket material so as to protect the insulated conductors from mechanical damage and to join the insulated conductors with the core jacket as a unit. The pressure containment layer 8 is surrounded by one or more armor layers, such as an inner armor layer 9 and an outer armor layer 10. The armor layers may form a conventional contra-helical armor package (in which layer 10 is wound oppositely to layer 9) to provide the required mechanical strength to the cable longitudinal structure.

Figure 2:
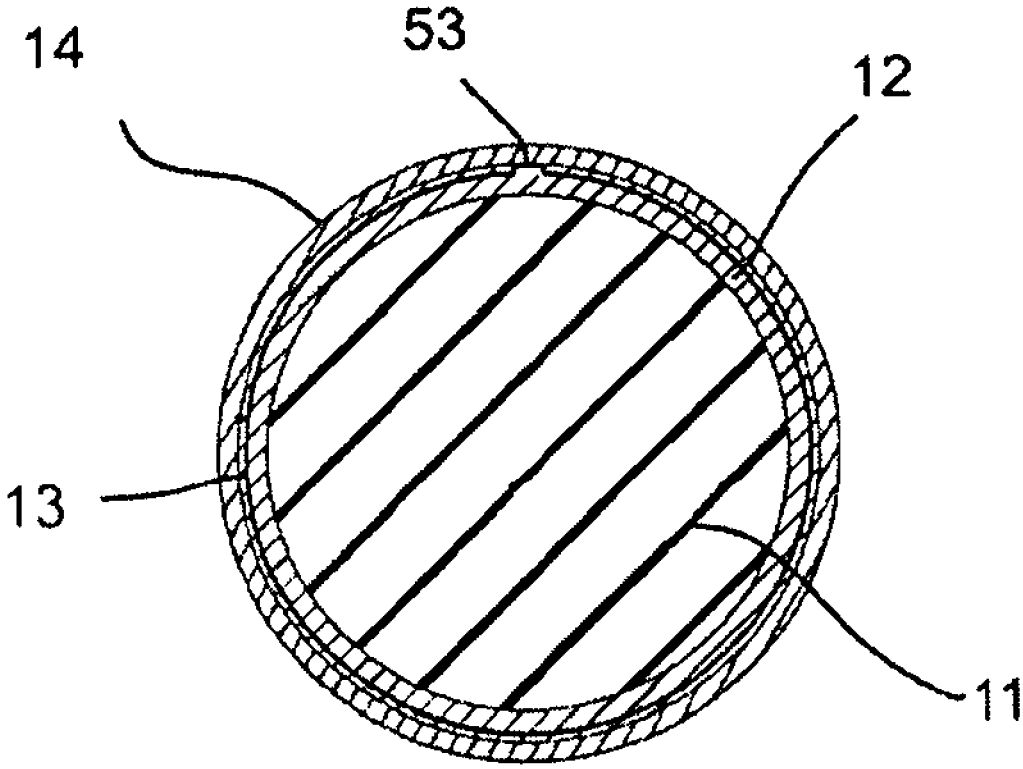
FIG. 2 is a cross section of a conductive cable.

Referring first to FIG. 2, the central member 11 is made from beryllium copper. This has both excellent electrical and mechanical properties, so it both provides an excellent conduit for electrical power and telemetry, while also it has abundant load carrying capabilities.

It is insulated using either an extrusion 12 or tape, and then a thin layer of copper or beryllium copper foil 13 is laid onto the outer layer prior to an outer stainless steel sheath 14, which is seam welded at a diameter slightly larger than the required diameter and then swaged down to a snug fit to the copper foil. It is envisaged that the seam welding and swaging are both carried out simultaneously, the swaging occurring a short distance down the line from the seam welding.

Figure 3:
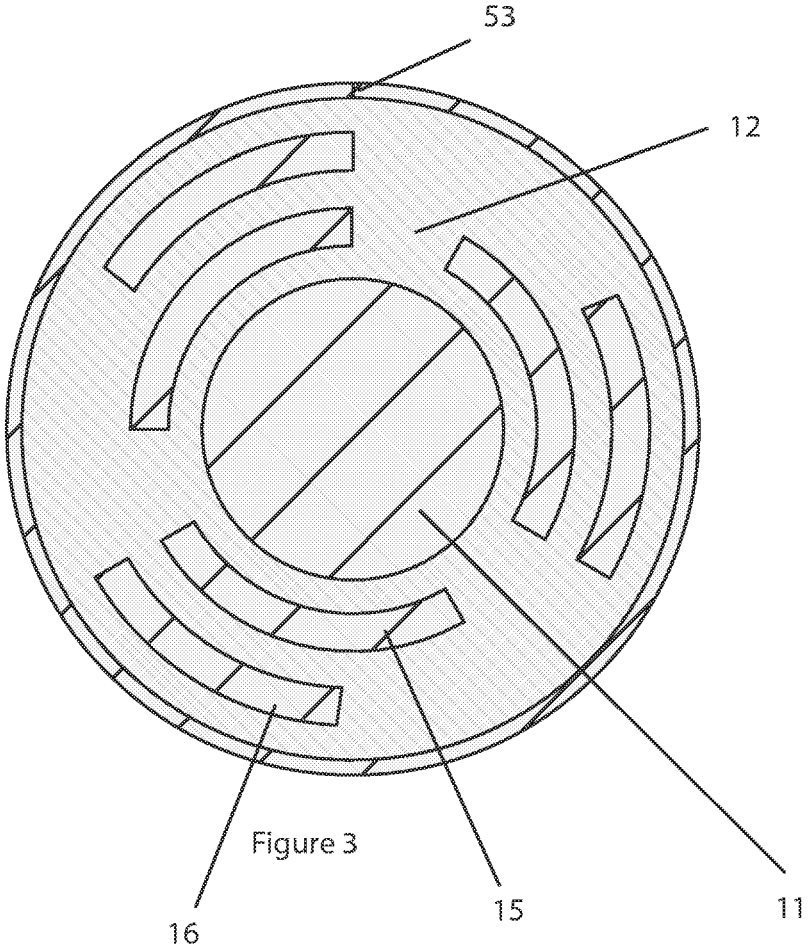
FIG. 3 is a cross section of another embodiment of a conductive cable.

Next referring to FIG. 3, there is shown a multi conductor version of the cable shown in FIG. 2. Again it consists of a central core 11 which is made from beryllium copper, and again this has a layer of tape or extruded insulation layer 12. Over this three flat conductors are laid per additional layer. The first layer 15 they are laid with a clockwise turn and the second layer 16 an anti-clockwise turn, their areas and moments action are carefully chosen so that they are torque balanced. This results in a cable which can transmit high voltages and currents without any serious induction losses, yet it still has all the benefit that the two outer conductor layers the tensile load equivalent to their cross sectional area. Finally, insulation is either extruded in one operation around the multi conduit cable or in multi stages. In addition an outer stainless steel layer can be applied as with the cable in FIG. 2 to hermetically seal the cable from all the aggressive fluids present in the majority of wellbores.

Figure 4:
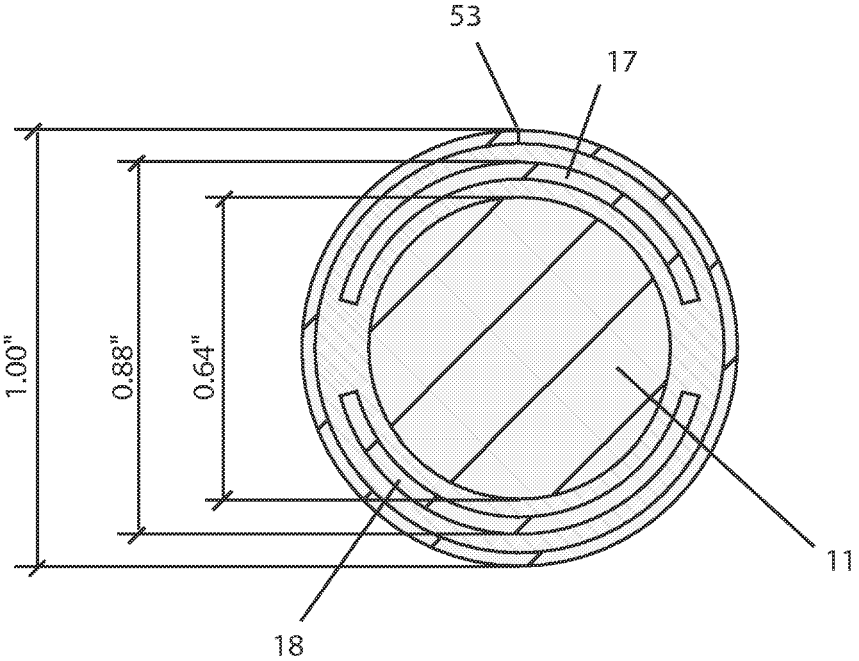
FIG. 4 is a cross section of another embodiment of a conductive cable.

Next referring to FIG. 4, there is shown a three phase cable. In this instance the central core is oversized and dominant both in electrically transmission capability and mechanical tensile load capability. It is encased in an extruded insulation layer. On this layer two foils 17, 18 of thin copper are laid which each have the required cross sectional area for the equivalent awg size cable. These are orientated helically around the outside of the first insulation layer. A second extruded insulation layer is applied over the two copper foils. This could be the final product or an outer stainless steel layer can be applied as with the cable in FIG. 1 to hermetically seal the cable from all the aggressive fluids present in the majority of wellbores.

Figure 5:
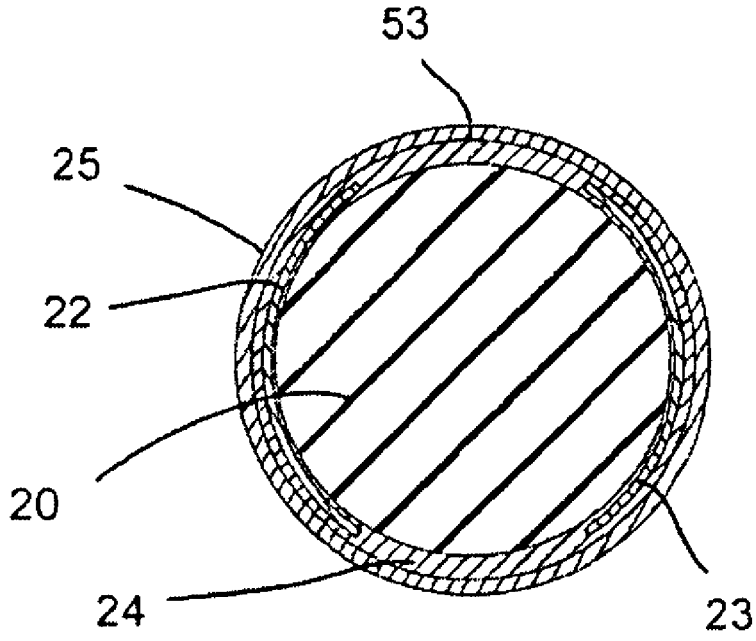
FIG. 5 is a cross section of an instrumentation slickline type cable.
Figure 6:
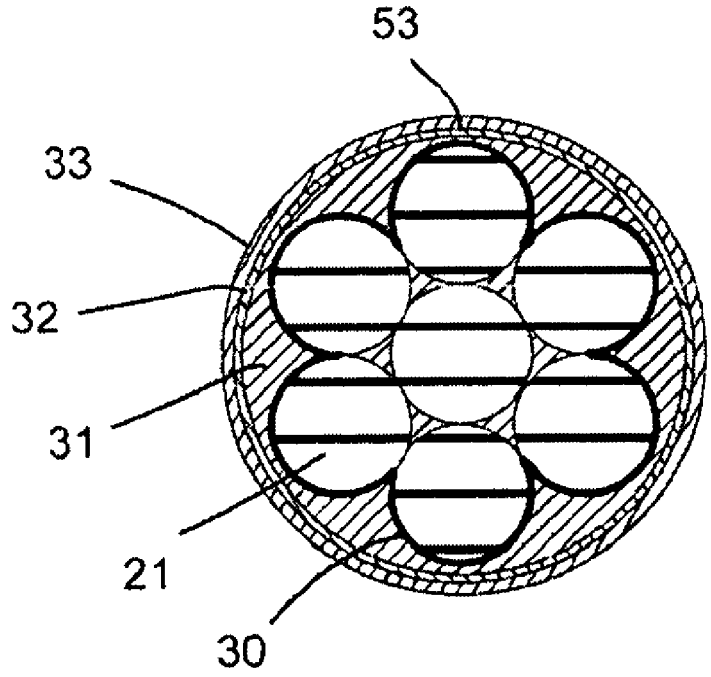
FIG. 6 is a cross section of another embodiment of an instrumented slickline cable.

Next referring to FIGS. 5 and 6 there are shown two variations of a slickline type cable with built in intelligence. The main core 20 is either steel piano wire or braided wire 21 for added flexibility.

In one version, two copper foils 22, 23 are embedded into the extruded plastic insulation material 24. This is then encapsulated in a thin stainless steel sheath 25 seam welded and then swaged down to a tight fit onto the extruded plastic insulation.

In the case of the second version, the inner core 21 of normal steel wire, is copper coated 30, this provides an excellent conductive path for telemetry signals at high strength and low cost, and also has good flexibility. The entire wire bundle is encapsulated in an extruded plastic 31. This is then hermetically encapsulated in a thin stainless steel sheath 33 seam welded and then swaged down to a tight fit onto the extruded plastic insulation, on the inner surface of the stainless steel tube is a copper deposited layer 32, which provides a return path for the telemetry signal of approximately the same resistance.

Figure 7:
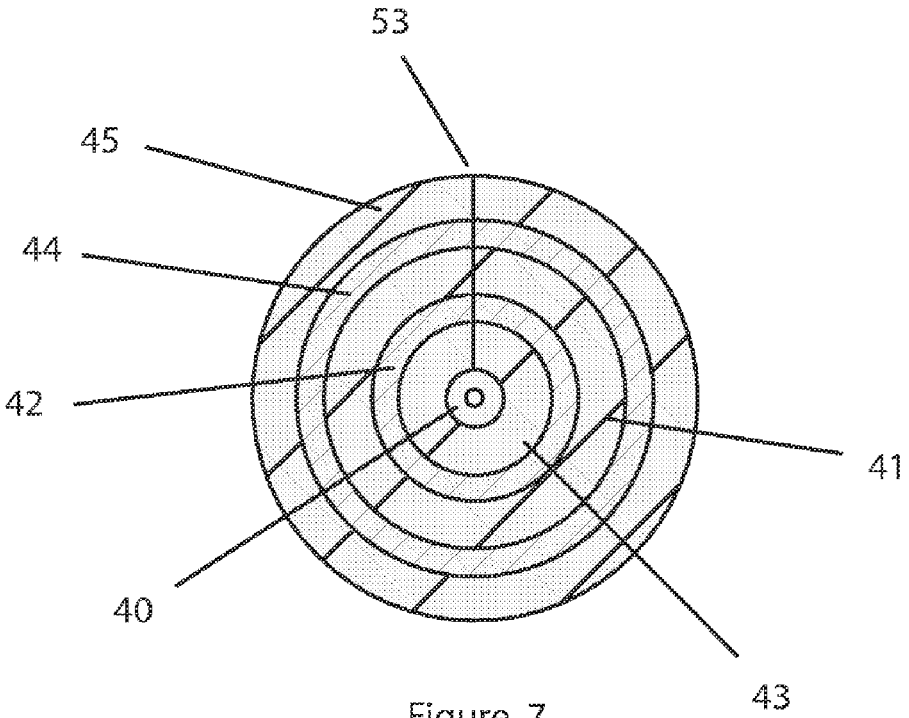
FIG. 7 is a cross section of another embodiment of an instrumented slickline cable.
Figure 8:
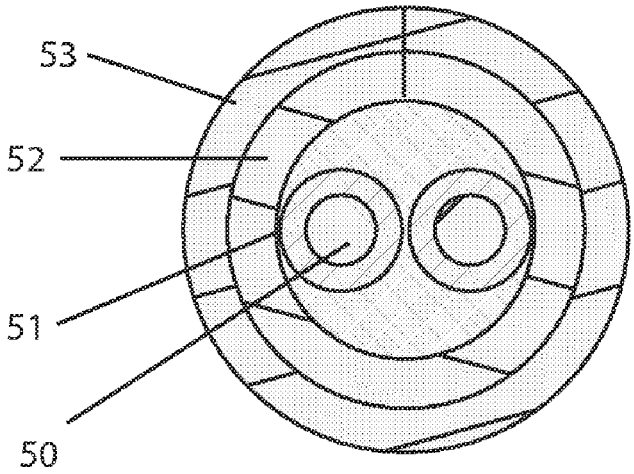
FIG. 8 is a cross section of another embodiment of an instrumented slickline cable.

FIGS. 7 and 8 show concentric layer construction. In the inner core of FIG. 7 is a fibre optic cable 40, outside this is a beryllium copper seam welded tube 43, outside this is an extruded insulation tube 42, outside this is a second beryllium copper seam welded tube 41, then outside this is a second insulated tube 44 with finally an outer layer of beryllium copper 45 is hermetically sealed to prevent wellbore fluids attacking the inner electrical carrying tubes 41 and 43. In this case the entire structure is beryllium copper to ensure equal expansion in the well and allow the entire structure to carry the tensile load. Because it is also a set of enclosed tubes it will be relatively stiff, and hence able to transfer compressive loads.

The construction shown in FIG. 8 consists of a twisted copper pair 50 encapsulated in an elastomer jacket 51. This is encased in two layers of seam welded stainless steel 52, 53, which hermetically seals the cable, and are swaged tight to each subsequent layer.

Figure 9:
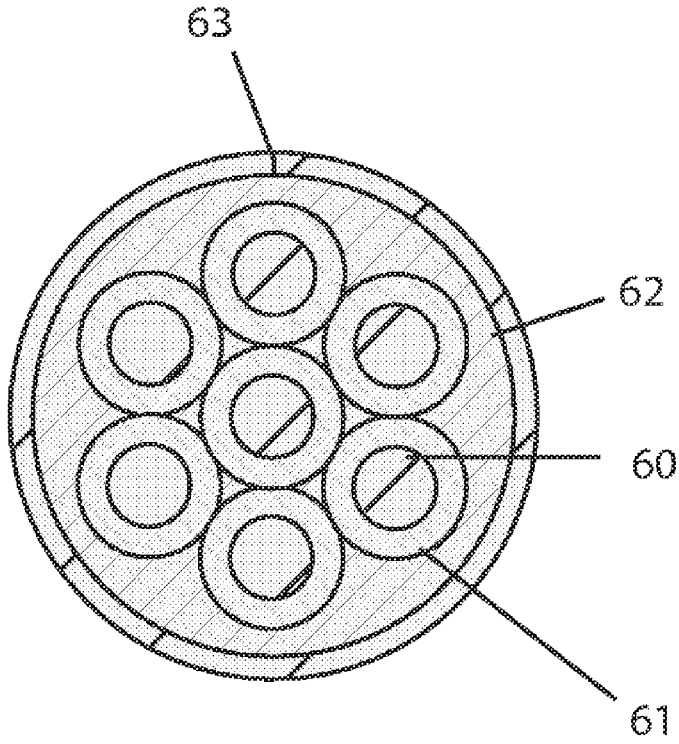
FIG. 9 is a cross section of another embodiment of an instrumented heta slickline cable.

FIG. 9 shows the inner core consists of seven copper clad steel conductors 50, each with an insulated layer 51 and spiraled together to form a bundle. This is then encapsulated in a jacket 52, which is finally encased in a seam welded stainless steel jacket 53. The thickness of this jacket also provides the torque balance for the helically spiraled conductors 50, 51.

Figure 10:
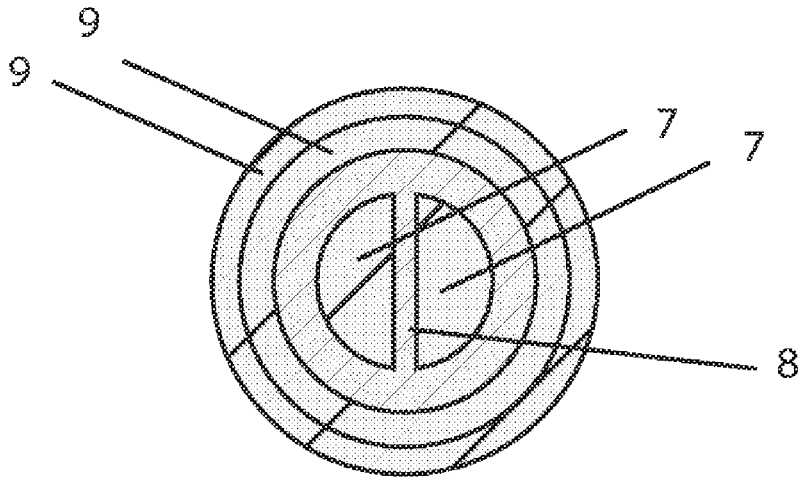
FIG. 10 is a cross section of an electrical conductor instrumentation 2 layer metal clad cable.

Next referring to FIG. 10, the central core consists of 2 "D" shape copper clad steel conductors 7, these are electrically insulated 8 from each other and provide significant tensile strength to the assembly in there own right. It is then metal clad 9 with further layers to protect the core and provide tensile strength.

Figure 11:
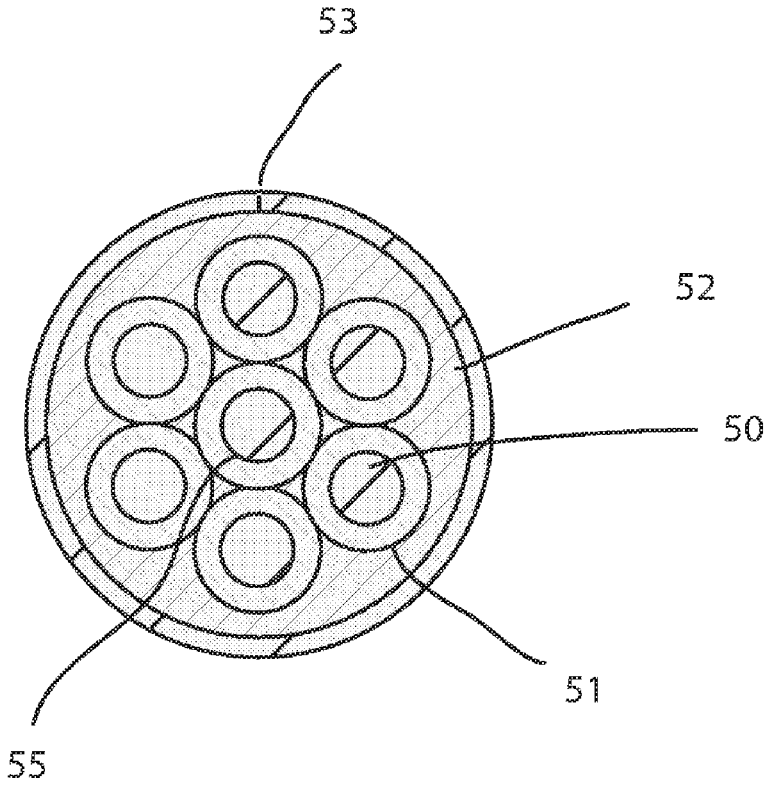
FIG. 11 is a cross section of an electrical conductor instrumentation slickline cable with six conductors.

Referring to FIG. 11, this embodiment is similar to the electrical cable shown in FIG. 9, however the central member 55 is a metal tube such as steel which is included for torsional stiffness.

Figure 12:
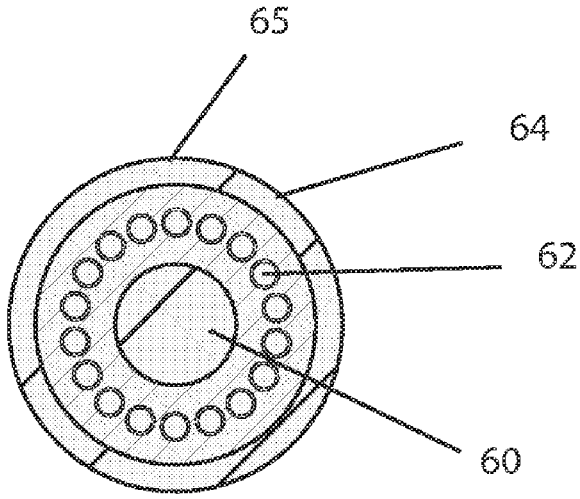
FIG. 12 is a cross section of an electrical conductor instrumentation slickline cable showing two conducting paths.

Referring to FIG. 12, a central beryllium-copper core 60 is surrounded by a layer of copper-clad members 62 in a spaced annular arrangement. These members may be twisted clockwise. In turn these are surrounded by a layer of layers of hermetically sealed steel 64. The beryllium-copper core 60 and copper-clad high stensil strength steel members 62 are set in an extruded insulator material 65.

Figures 13, 14:
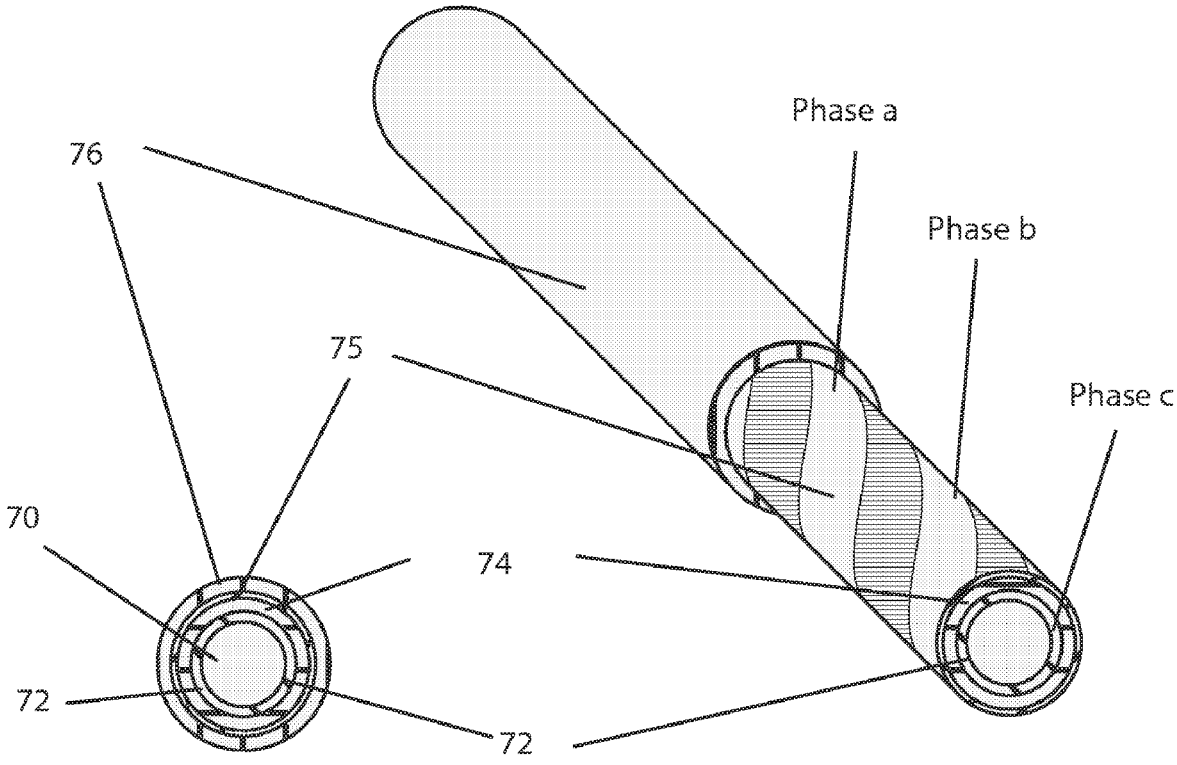
FIGS. 13 and 14 are a perspective view and cross section of another electrical conductor instrumentation slickline cable showing two conducting paths.

Referring to FIGS. 13 and 14, a central conducting element of copper-clad steel 70 is surrounded by a layer of insulating material 72, which is in turn surrounded by a layer of conductive tape 74, which may for example be copper-coated tape. Finally, the conductive tape 74 is surrounded by one or more layers of seam-welded stainless steel 75, 76, which may provide some of the cables tensile strength. The conductive tape may either form a single conductive tubular member, or, as shown here, it may be formed from two separate strips of conductive tape, possible separated by strips of insulating tape, so that three conductive lines in total are provided along the cable.

The invention claimed is:

1. In combination with an electrically powered tool down in a borehole, a cable for suspending the tool in the borehole for supplying electrical power to the tool, the cable comprising:

a conducting member of sufficient tensile strength to support the majority of the weight of the tool; and an insulating layer surrounding the conducting member.

2. The cable according to claim 1 wherein the conducting member comprises copper-clad steel.

3. The cable according to claim 1 wherein the conducting member comprises a beryllium-copper alloy.

4. The cable according to claim 1 wherein the conducting member has a sufficient tensile strength to support a 500 lb payload and its own weight over 20000 feet.

5. The cable according to claim 1 wherein the conducting member includes two or more separate electrically insulated conductors.

6. The cable according to claim 1, further comprising a chemically protective layer.

7. The cable according to claim 6 wherein the chemically protective layer is of metal.

8. The cable according to claim 1, further comprising a fiber-optic cable.

9. The cable according to claim 8, further comprising at least one beryllium copper conductor concentrically surrounding the fiber-optic cable.

10. The cable according to claim 8, further comprising an outer layer of the same material as the conducting member surrounding the insulating layer.

* * * * *